US006382218B1

(12) United States Patent
Cheng

(10) Patent No.: US 6,382,218 B1
(45) Date of Patent: May 7, 2002

(54) HEADBAND ASSEMBLY HAVING AN ORNAMENTAL CROWN

(76) Inventor: Chen-An Cheng, No. 1-5, Alley 112, Lane 150, Section 2, Hai Tian Road, Tainan (TW)

( * ) Notice: Subject to any disclaimer, the term of this patent is extended or adjusted under 35 U.S.C. 154(b) by 0 days.

(21) Appl. No.: 09/900,857

(22) Filed: Jul. 10, 2001

(51) Int. Cl.[7] ..... A45D 8/14
(52) U.S. Cl. ..... 132/275; 63/3
(58) Field of Search ..... 132/273, 275; 63/3, 11, 26; 2/171, 209.13, 918, DIG. 11; D2/865, 866, 871, 875, 880, 881, 891, 895; D11/1, 2, 3, 4; D28/39, 40, 41, 42, 43

(56) References Cited

U.S. PATENT DOCUMENTS

D7,152 S * 2/1874 Pauly ..... D28/28
248,542 A * 10/1881 Wilson ..... 132/275
D69,479 S * 2/1926 Bedack ..... D2/871
D400,340 S * 11/1998 Poczos ..... D2/866
5,926,848 A * 7/1999 Bartholomae ..... 2/171

FOREIGN PATENT DOCUMENTS

FR 1345930 * 11/1963 ..... 132/273

* cited by examiner

*Primary Examiner*—Todd E. Manahan
*Assistant Examiner*—David Comstock
(74) *Attorney, Agent, or Firm*—Rosenberg, Klein & Lee

(57) ABSTRACT

An open-loop headband assembly includes an open-loop headband and a top ornamental annulus. The top ornamental annulus can be the shape of a crown. The outer surface of the ornamental annulus is provided with shining articles. The bottom inner surface of the annulus is provided with two opposite connecting blocks. The open-loop headband is curved in shape, made of resilient material, and provided with shining articles on it's outer surface. Two opposite connecting blocks of the ornamental annulus are glued to the top of the headband to firmly secure the ornamental annulus to the top of the headband.

1 Claim, 3 Drawing Sheets

HEADBAND ASSEMBLY HAVING AN ORNAMENTAL CROWN

BACKGROUND OF THE INVENTION

1. Field of the Invention

The present invention relates to an open-loop headband assembly for use by women and particularly by young girls, and more particularly to an open-loop headband assembly which can be worn for purpose of hair control and decoration and whose top ornamental annulus can be firmly secured to the top of the headband.

2. Description of the Related Art

An ornamental annulus, such as a crown, is generally worn by a performer for the role he/she acts on the stage, and it is commonly worn by children for decoration. While being worn on the head of a wearer, an ornamental annulus will be easily fallen off because it can not be firmly secured to the head by hair clips or bandeau. Therefore, it always causes trouble for a wearer to worry about possible fall of the ornamental annulus on the head.

Probably the simplest form of head wear is the open-loop headband. The open-loop headband, which extends over the top of the head of a wearer, is used to secured to the head of a wearer so as to keep hair away from the face.

SUMMARY OF THE INVENTION

Accordingly, the present invention is directed to an open-loop headband assembly that can substantially obviate the drawback of an ornamental annulus and promote the aesthetic effect of a conventional related open-loop headband.

An object of the present invention is to provide an open-loop headband assembly which can be worn for purpose of hair control and decoration.

Another object of the present invention is to provide an open-loop headband assembly whose top ornamental annulus can be firmly secured to the top of the headband.

To achieve these advantages, an open-loop headband assembly in the present invention includes an open-loop headband and a top ornamental annulus. The top ornamental annulus can be the shape of a crown, and on the outer surface of the ornamental annulus are provided with shining articles. On the bottom inner surface of the annulus are provided with two opposite connecting blocks. The open-loop headband is curved in shape and made of resilient material, it is provided with shining articles on the outer surface, and on the inner top surface are provided with a row of teeth for the headband to firmly mounting on the hair. Two opposite connecting blocks of the ornamental annulus are glued to the top of the headband so as for the ornamental annulus to firmly secure to the top of the headband.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
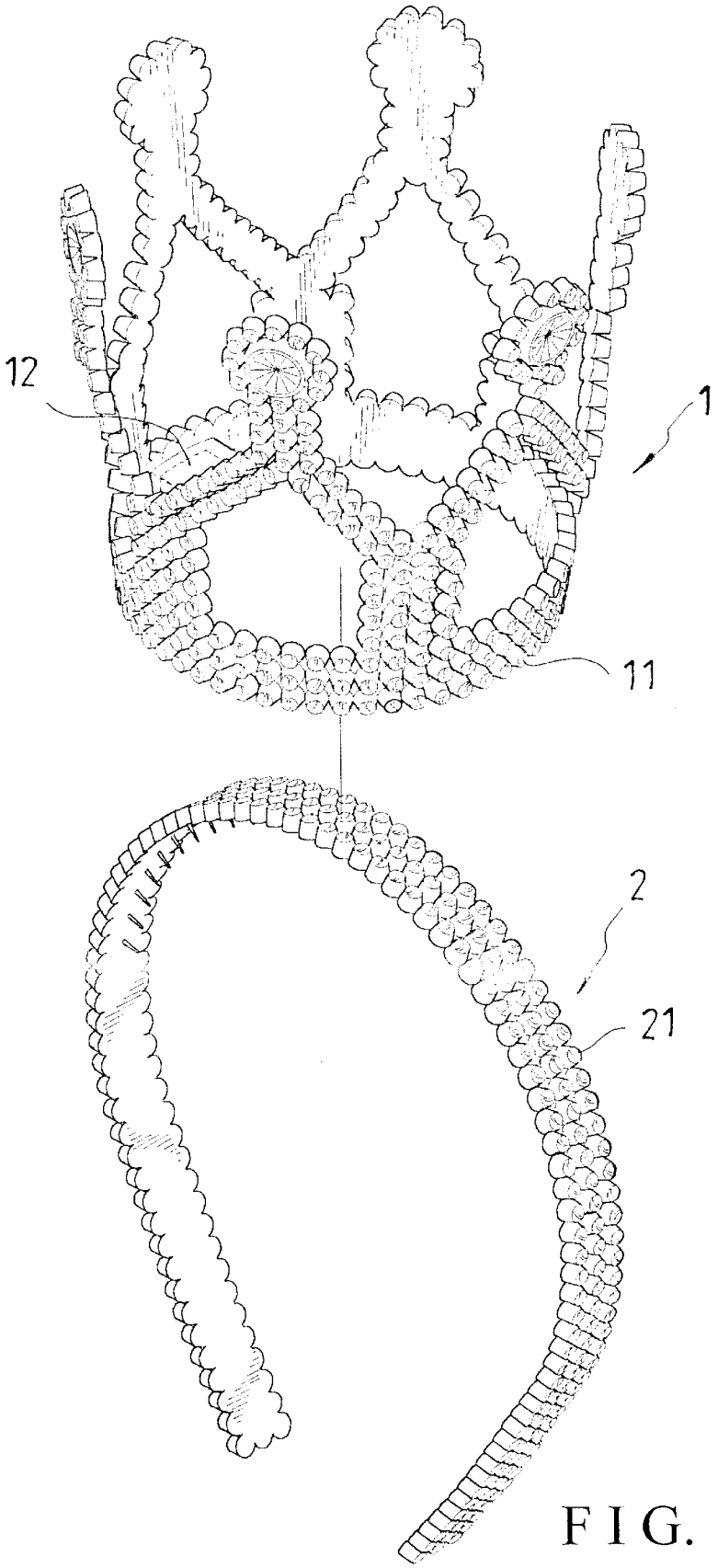
FIG. 1 is a perspective exploded view of an embodiment of an open-loop headband and an ornamental annulus in accordance with the present invention.

Referring to FIG. 1, a preferred embodiment of an open-loop headband assembly in the present invention includes a top ornamental annulus 1 and an open-loop headband 2. The top ornamental annulus 1 can be the shape of a crown, and on the outer surface of the ornamental annulus 1 are provided with shining articles 11 so as for the ornamental annulus 1 to look shining. On the bottom inner surface of the annulus 1 are provided with two opposite connecting blocks 12.

The open-loop headband 2 is one piece item, curved in shape and made of resilient material. The open-loop headband 2 is provided with shining articles 21 on the outer surface, and on the inner top surface are provided with a row of teeth for the headband to firmly mounting on the hair. Two legs of the headband 2 are provided to straddle the head and bear against the sides of the head.

Figure 2:
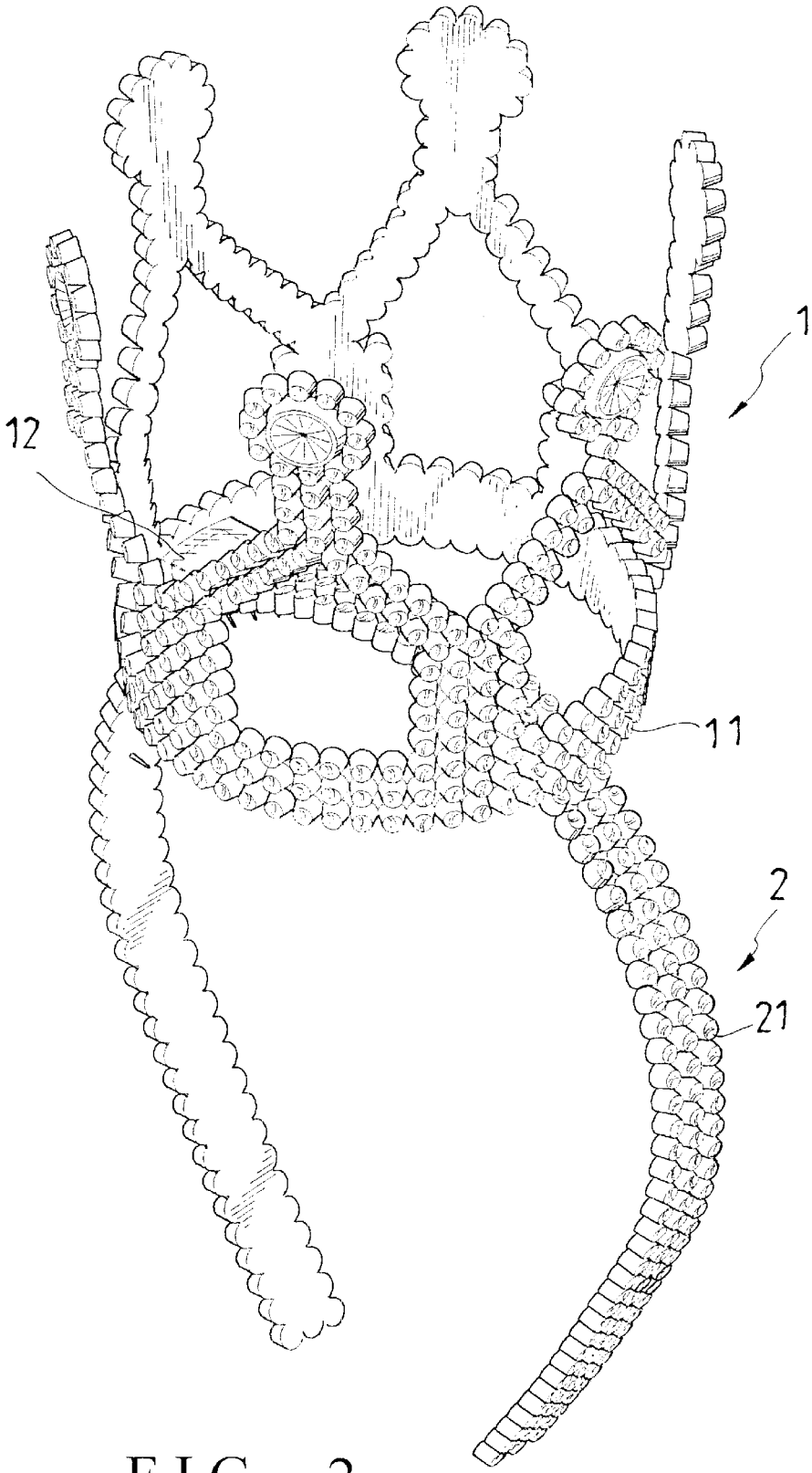
FIG. 2 is a perspective view of the open-loop headband assembly in assembled configuration in accordance with the present invention; and, FIG. 3 is a schematic front view of the open-loop headband assembly in assembled configuration with the connecting blocks being glued to the top of the open-loop headband in accordance with the present invention.
Figure 3:
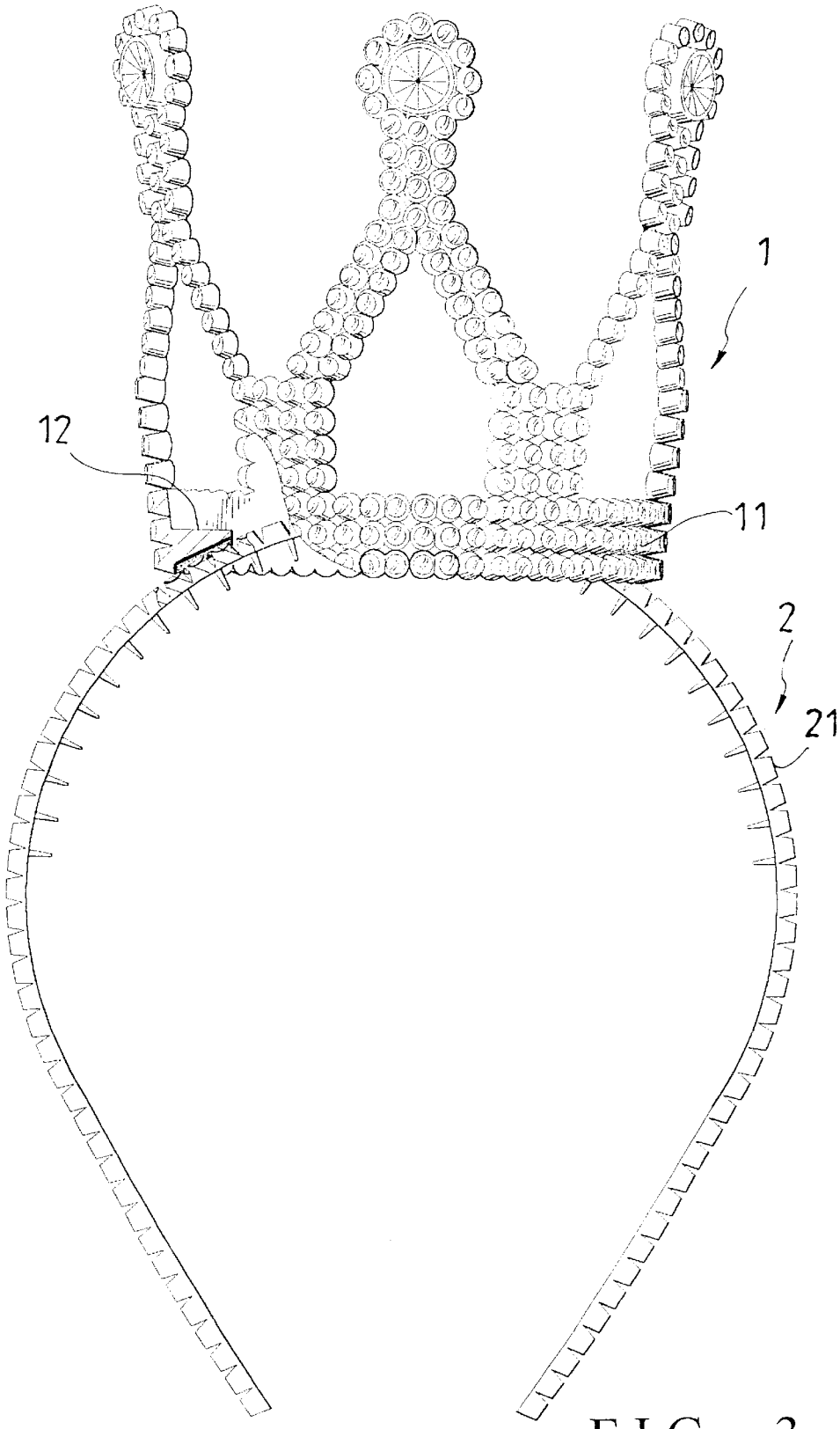

Referring to FIGS. 2 and 3, while being assembled, two opposite connecting blocks 12 of the ornamental annulus 1 are glued to the shining articles 21 on the top surface of the headband 2 so as for the ornamental annulus 1 to firmly secure to the top of the headband 2. While being used, the whole open-loop headband assembly can be easily and firmly worn on the head of a wearer with two legs of the headband 2 straddling the head and bearing against the sides of the head.

While the preferred embodiments of the invention have been described above, it will be recognized and understood that various modifications may be made thereto and the appended claims are intended to cover all such modifications which may fall within the spirit and scope of the invention.

What is claimed is:

1. An open-loop headband assembly comprising:

a top ornamental annulus having a predetermined crown contour, said ornamental annulus including a plurality of first shining articles disposed on an outer surface portion thereof, said ornamental annulus having a pair of connecting blocks extending in opposing manner from an inner surface portion thereof; and, a resilient open-loop headband coupled to said top ornamental annulus, said open-loop headband having an arcuately contoured one-piece configuration terminating at a pair of legs for resiliently capturing therebetween the head of a wearer, said open-loop headband including a plurality of second shining articles disposed on an outer surface portion thereof, said open-loop headband having a plurality of teeth extending from an inner top surface portion thereof for engaging the hair of the wearer, said open-loop headband being adhesively secured at an upper portion thereof to said connecting blocks of said top ornamental annulus.

* * * * *